US006657480B2

(12) United States Patent
Ochi

(10) Patent No.: US 6,657,480 B2
(45) Date of Patent: Dec. 2, 2003

(54) CMOS COMPATIBLE BAND GAP REFERENCE

(75) Inventor: Sam S. Ochi, Saratoga, CA (US)

(73) Assignee: Ixys Corporation, Santa Clara, CA (US)

( * ) Notice: Subject to any disclaimer, the term of this patent is extended or adjusted under 35 U.S.C. 154(b) by 0 days.

(21) Appl. No.: 09/910,426

(22) Filed: Jul. 20, 2001

(65) Prior Publication Data

US 2002/0070793 A1 Jun. 13, 2002

Related U.S. Application Data

(60) Provisional application No. 60/220,068, filed on Jul. 21, 2000.

(51) Int. Cl.[7] ..... G05F 1/56
(52) U.S. Cl. ..... 327/539; 323/314
(58) Field of Search ..... 327/539; 323/313, 323/314, 907

(56) References Cited

U.S. PATENT DOCUMENTS 4,524,318 A * 6/1985 Burnham et al. ..... 323/313
4,525,663 A * 6/1985 Henry ..... 323/280
4,897,595 A * 1/1990 Holle ..... 323/314
4,939,442 A * 7/1990 Carvajal et al. ..... 323/314
5,923,208 A * 7/1999 Tasdighi et al. ..... 327/538
5,936,391 A 8/1999 Larsen et al.
6,075,354 A 6/2000 Smith et al.
6,121,824 A * 9/2000 Opris ..... 327/539
6,133,719 A * 10/2000 Maulik ..... 323/313
6,281,743 B1 8/2001 Doyle
6,294,902 B1 * 9/2001 Moreland et al. ..... 323/314
6,433,529 B1 * 8/2002 Chowdhury ..... 323/316

OTHER PUBLICATIONS

Paul R. Gray et al., "Analysis and Design of Analog Integrated Circuits", John Wiley & Sons, Inc. 1977, pp. 338–347.

Paul Horowitz et al., "The Art of Electronics", Cambridge University Press, 1980, pp. 335–341.

* cited by examiner

*Primary Examiner*—Timothy P. Callahan
*Assistant Examiner*—Terry L. Englund
(74) *Attorney, Agent, or Firm*—Townsend and Townsend and Crew LLP; Steven J. Cahill

(57) ABSTRACT

A CMOS low noise band gap reference circuit outputs a substantially constant reference voltage $V_{REF}$. The band gap reference circuit has an amplifier that includes a differential pair of bipolar junction transistors and a feedback circuit that adjusts its current to compensate for variations in the bias current through the circuit. The band gap reference circuit provides an output reference voltage $V_{REF}$ that is substantially constant over a range of temperature and a range of supply voltage.

28 Claims, 4 Drawing Sheets

CM OS COMPATIBLE BAND GAP REFERENCE

CROSS-REFERENCES TO RELATED APPLICATIONS

This application claims priority from U.S. Provisional Patent Application No. 60/220,068, filed Jul. 21, 2000, which is incorporated by reference herein.

BACKGROUND OF THE INVENTION

The present invention relates to band gap reference circuits, and more particularly, to band gap reference circuits that maintain a constant output voltage over a range of temperature and bias current.

A band gap reference circuit provides a constant output reference voltage $V_{REF}$. Problems may arise if the output reference voltage $V_{REF}$ varies even by a small amount such as a few hundred millivolts over a range of temperature or bias current. Therefore, it is desirable to provide a band gap reference circuit that provides an output reference voltage $V_{REF}$ that is substantially constant over a range of temperature and bias current.

Previously known standard CMOS band gap reference circuits typically include an amplifier that comprises a differential pair of p-channel MOS transistors. $V_{REF}$ is determined by the voltage at the gate of one of the p-channel MOS transistors. Excess charge carriers can become trapped in the silicon to silicon dioxide ($SiO_2$) interface in MOS transistors. The excess charge may cause variations in the threshold voltages of the MOS transistors in the differential pair of the amplifier. For example, the threshold voltages of the two MOS transistors in the differential pair may differ by more than 5 mV. This difference introduces an offset voltage into the amplifier which appears at $V_{REF}$ of the band gap reference circuit. The offset voltage can prevent the band gap reference circuit from being adjusted with trimming resistors so that $V_{REF}$ remains constant with temperature changes.

In addition, the charge trapped in the silicon/$SiO_2$ interface of the differential pair MOS transistors in the band gap reference amplifier can vary over time causing $V_{REF}$ to change over time even at a constant temperature. These variations in $V_{REF}$ cause undesirable 1/f output noise. Also, the p-channel MOS transistors in the differential pair may introduce thermal noise at $V_{REF}$ due to the nature of MOS transistors, which is also undesirable.

A further disadvantage of previously known standard CMOS band gap reference circuits is that they are sensitive to relatively small changes in the supply voltage $V_{CC}$. Small changes in $V_{CC}$ cause variations in the bias current through the band gap reference circuit, which can cause undesirable changes in $V_{REF}$.

It would therefore be desirable to provide a less noisy band gap reference circuit in CMOS technology that provides a substantially constant output reference voltage $V_{REF}$ over a range of supply voltage and a range of temperature.

BRIEF SUMMARY OF THE INVENTION

The present invention provides CMOS low noise band gap reference circuits that output a substantially constant reference voltage $V_{REF}$. Band gap reference circuits of the present invention have an amplifier that includes a differential pair of bipolar junction transistors. Each of the bipolar junction transistors are coupled to a first or a second plurality of bipolar junction transistors or a first and second plurality of diodes. The first and second plurality of transistors or diodes are coupled to a plurality of resistors. When the temperature of the circuit varies over a range, the change in the voltage drop across the resistors compensates for the change in the voltage drop across the transistors or the diodes so that $V_{REF}$ remains substantially constant.

A feedback circuit is coupled to the amplifier. The feedback circuit adjusts its current to compensate for variations in the supply current so that the $V_{REF}$ remains substantially constant. The band gap reference circuits of the present invention provide a output reference voltage $V_{REF}$ that is substantially constant with variations over a range of temperature and supply voltage. Band gap reference circuits of the present invention may be fabricated using standard CMOS process techniques.

DETAILED DESCRIPTION OF THE INVENTION

Figure 1:
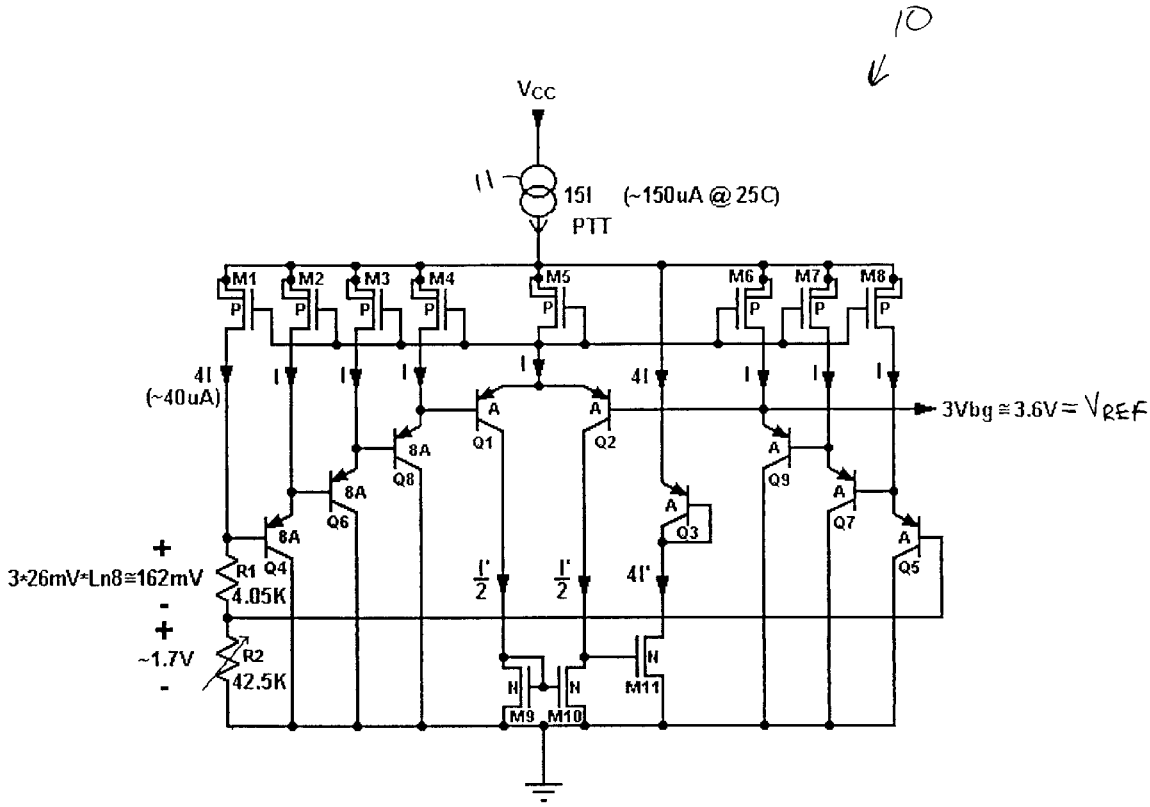
FIG. 1. is a schematic of an embodiment of a band gap reference circuit of the present invention.

Band gap reference circuit 10 shown in FIG. 1 is an embodiment of the present invention. Reference circuit 10 receives supply voltage $V_{CC}$ from an external voltage source. Bias current source 11, which has a finite impedance, provides a reference current source that outputs a current equal to 15I to reference circuit 10. For example, 15I may represent 150 $\mu$A at 25° C. Bias current source 11 is proportional to absolute temperature. Therefore, changes in the temperature of circuit 10 or changes in $V_{CC}$ cause the current through current source 11 to vary.

The current through bias current source 11 is divided through p-channel MOS transistors M1–M8 and M11 according to the predetermined proportions which are determined by the relative channel width-to-length (W/L) ratios of MOSFET transistors M1–M8 and M11. For example, the W/L ratio of transistors M1:M2:M3:M4:M5:M6:M7:M8 may be 4:1:1:1:1:1:1:1 which provides a current ratio of 4I:I:I:I:I:I:I:I as shown in FIG. 1. MOS transistor M11 has a W/L that is eight times the W/L of MOS transistors M9 and M10. Other suitable transistor ratios may be used, if desired, according to the principles of the present invention. In a further embodiment of the present invention, MOSFET transistors M1–M8 may be replaced with PNP bipolar junction transistors that are sized to provide the desired bias current ratio in circuit 10.

Band gap reference circuit 10 includes PNP bipolar junction transistors (BJTs) Q1 and Q2, which from a differential pair for an amplifier. When the voltages at the bases of Q1 and Q2 are equal, a current equal to one half of current I (I'/2) flows through both Q1 and Q2, and n-channel MOS transistors M9 and M10, which form a current mirror.

Circuit 10 also includes PNP BJTs Q4–Q9. The base of transistor Q2 is coupled to the output reference voltage Vref, which is determined by the equation (1).

$$V_{REF}=V_{R2}+V_{BE\text{-}Q9}+V_{BE\text{-}Q7}+V_{BE\text{-}Q5} \quad (1)$$

$V_{R2}$ is the voltage drop across R2, $V_{BE\text{-}Q9}$ equals the base-emitter voltage drop across Q9, $V_{BE\text{-}Q7}$ equals the base-emitter voltage drop across Q7, and $V_{BE\text{-}Q5}$ equals the base-emitter voltage drop across Q5. The voltage at the base of transistor Q1 is determined by equation (2).

$$V_{Q1}=V_{R1}+V_{R2}+V_{BE\text{-}Q8}+V_{BE\text{-}Q6}+V_{BE\text{-}Q4} \quad (2)$$

$V_{Q1}$ is the base voltage of transistor Q1, $V_{R1}$ is the voltage drop across resistor R1, $V_{BE\text{-}Q8}$ equals the base-emitter voltage drop across Q8, $V_{BE\text{-}Q6}$ equals the base-emitter voltage drop across Q6, and $V_{BE\text{-}Q4}$ equals the base-emitter voltage drop across Q4.

Figure 2A:
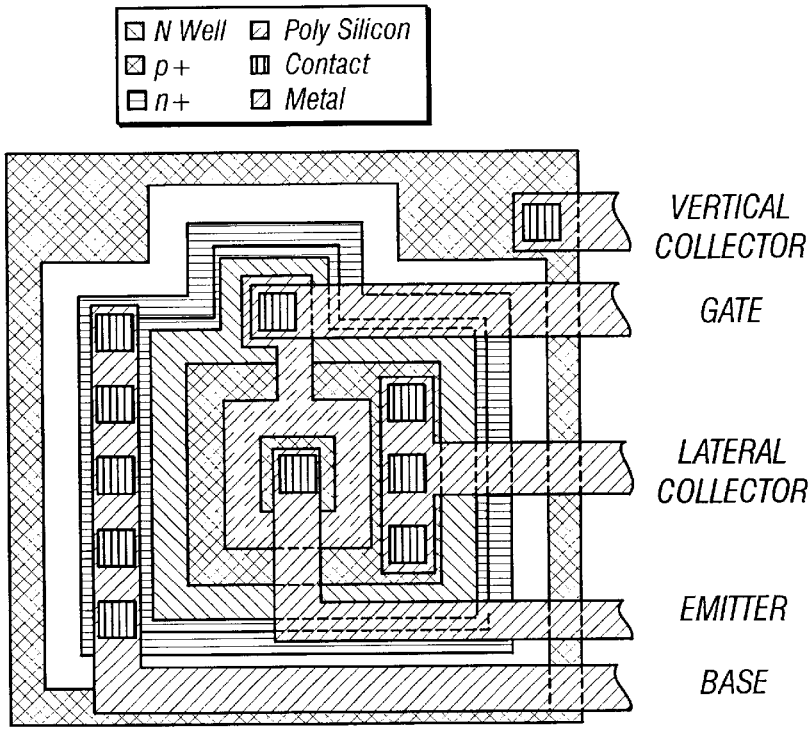
FIGS. 2A–2B illustrate top down and cross sectional layout views, respectively, of a CMOS compatible lateral PNP bipolar junction transistor in accordance with the principles of the present invention.
Figure 2B:
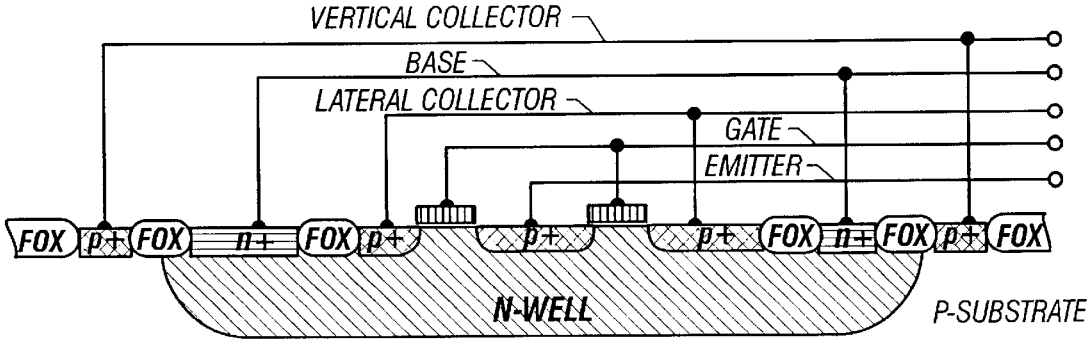
Figure 2C:
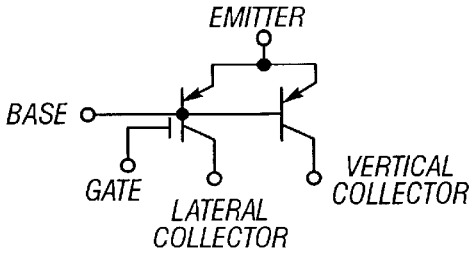
FIG. 2C illustrates a schematic of the lateral PNP BJT of FIGS. 2A–2B.

BJTs Q1–Q9 may be CMOS compatible lateral PNP bipolar junction transistors. FIGS. 2A–2B illustrate top down and cross sectional views of an embodiment of a CMOS compatible lateral PNP bipolar junction transistor that may be used to form BJTs Q1–Q9. FIG. 2C illustrates a schematic of a lateral PNP BJT. The lateral PNP BJT shown in FIGS. 2A–2B includes a P+ emitter diffusion region, an N-well base region, and a P+ lateral collector diffusion region. The lateral PNP BJT of FIGS. 2A–2B can be made using standard CMOS process techniques that are used to form a p-channel MOSFET transistor. No new layers or process steps are required. The gate terminal in FIGS. 2A–2B is biased so that the parallel PMOS device is kept off. The vertical collector terminal is not used. Lateral PNP BJTs have a relatively high base-to-collector current gain β (e.g., 100).

Figure 3A:
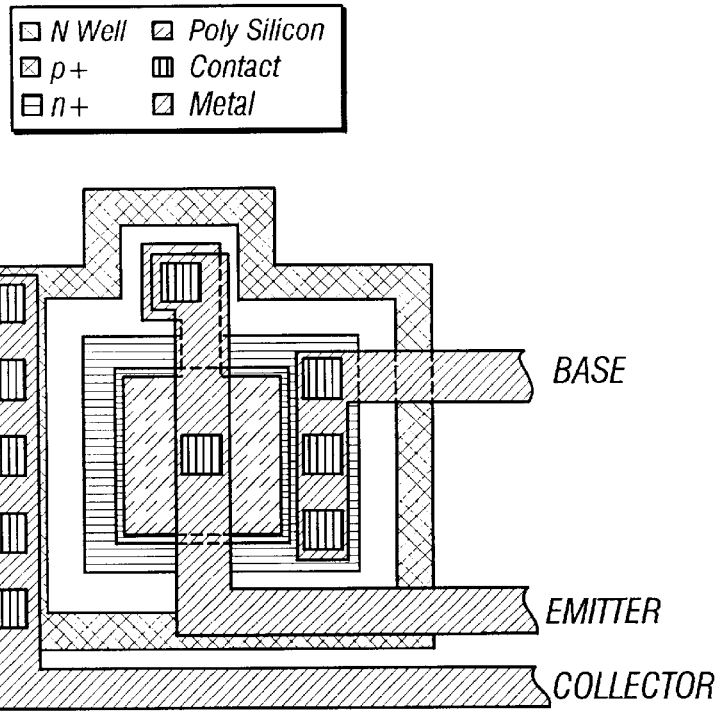
FIGS. 3A–3B illustrate top down and cross sectional layout views, respectively, of a CMOS compatible vertical PNP bipolar junction transistor in accordance with the principles of the present invention.
Figure 3B:
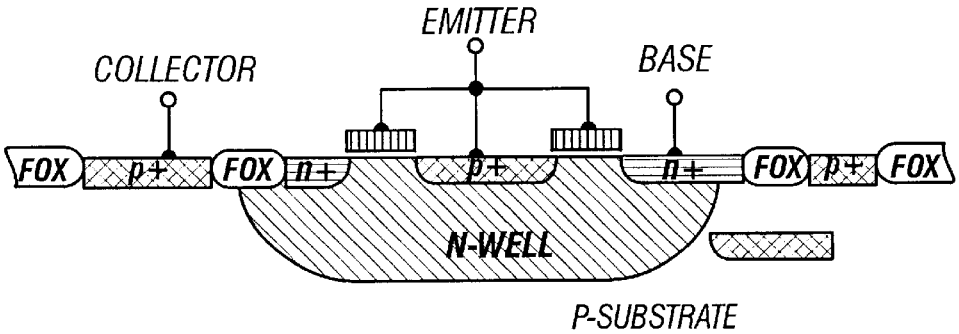
Figure 3C:
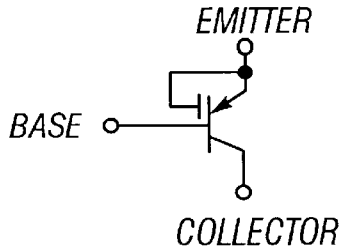
FIG. 3C illustrates a schematic of the vertical PNP bipolar junction transistor of FIGS. 3A–3B.

In a further embodiment, BJTs Q4–Q9 may be compatible vertical PNP bipolar junction transistors. FIGS. 3A–3B illustrate top down and cross sectional views of an embodiment of a CMOS compatible vertical PNP bipolar junction transistor that may be used to form BJTs Q4–Q9. FIG. 3C illustrates a schematic of a vertical PNP BJT. The PNP transistor in FIGS. 3A–3B includes an emitter P+diffusion region, an N-well base region, and a P+ collector region coupled to the P-substrate. Thus, the collector of the vertical PNP BJT is coupled to the P-substrate. Transistors Q4–Q9 can be vertical PNP BJTS, because their collectors are coupled directly to ground. Transistors Q1–Q3 cannot be vertical PNP BJTS, because their collectors are not coupled directly to ground. The vertical PNP BJT of FIGS. 2A–2B can be made using standard CMOS process techniques that are used to form a p-channel MOSFET transistor. Vertical PNP BJTs have a relatively high base-to-collector current gain β (e.g., 500).

BJTs Q4, Q6, and Q8 have base-emitter junction areas that are 8 times the base emitter junction areas of BJTs Q5, Q7, and Q9. Therefore, base-emitter voltage $V_{BE}$ of each of transistors Q4, Q6, and Q8 are 26 mV·ln(8)=54 mV greater than the base-emitter voltages $V_{BE}$ of each of transistors Q5, Q7, and Q9. The total voltage drop of $V_{BE\text{-}Q8}+V_{BE\text{-}Q6}+V_{BE\text{-}Q4}$ is 162 mV greater than the total voltage of $V_{BE\text{-}Q9}+V_{BE\text{-}Q7}+V_{BE\text{-}Q5}$. Therefore, the resistance of resistor R1 should be selected so that the voltage drop across R1 equals 162 mV so that the voltage at the base of Q1 equals the voltage at the base of Q2. For example, the voltage drop across R1 is 162 mV when R1 is 4.05 kΩ and the current of through R1 is 40 μA. When the voltages at the bases of Q1 and Q2 are equal, circuit 10 is in an equilibrium state and outputs a constant output voltage $V_{REF}$.

When the temperature of circuit 10 increases, the base-emitter junction voltage drops across the bipolar junction transistors Q5, Q7, and Q9 decreases, and the voltage drop across resistors R1 and R2 increases. When the temperature of circuit 10 decreases, the voltage drop across base-emitter junctions of BJTs Q5, Q7, and Q9 increases, and the voltage drop across R1 and R2 decreases. If a temperature change in circuit 10 causes a voltage change in $V_{REF}$ away from a desired value (e.g., 3.6 volts), a trimming resistor can be added in series or in parallel with resistor R2 to bring $V_{REF}$ back up to the desired value. The trimming resistor can be coupled to R2 using fusible links that are isolated with respect to ground to reduce parasitic capacitance.

Once circuit 10 has been adjusted to reach a balance point (so that $V_{REF}$ is at the desired value), then temperature changes over a range (e.g., −40° C.–125° C.) in circuit 10 do not cause voltage changes in $V_{REF}$. At the balance point of circuit 10, a change in the voltage drop across the base-emitter junctions of BJTs Q5, Q7, and Q9 is offset by a change in the voltage drop across resistor R1 when the temperature of circuit 10 changes such that the voltage of $V_{REF}$ remains substantially constant (e.g., within a few millivolts). Therefore, trimming resistance may be added to circuit 10 to achieve a zero temperature coefficient. If desired, resistor R1 can be selected at a single temperature to achieve the balance point at which $V_{REF}$ remains constant despite changes in temperature. Highly accurate measurements of resistances may be needed to achieve this result in one step.

The base-emitter threshold voltages of BJTs Q1 and Q2 are the substantially the same, and therefore a low offset voltage is introduced into $V_{REF}$. Variations in the base-emitter threshold voltages of BJTs are on the order of 100–1000 times less than variations in the threshold voltages of MOS transistors. Circuit 10 uses triple emitter followers Q4/Q6/Q8 and Q5/Q7/Q9 that provide a three times increase in the delta $V_{BE}$ (e.g., 3·54 mV) which reduces the effect of the small input offset voltages and noise voltages that are introduced by Q1 and Q2 into $V_{REF}$.

Thus, triple emitter followers Q4/Q6/Q8 and Q5/Q7/Q9 as shown in FIG. 1 is preferred. However, in a further embodiment, a first double emitter follower is coupled to the base of Q1 (e.g., by eliminating transistors Q4 and M2 in circuit 10), and a second double emitter follower is coupled to the base of Q2 (e.g., by eliminating transistors Q5 and M8). Also, in another embodiment, only a single BJT is coupled between the base of Q1 and R1, and a single BJT is coupled between the base of Q2 and R2 (e.g., by eliminating transistors Q4, Q5, Q6, Q7, M2, M3, M7 and M8 in circuit 10).

BJTs Q1 and Q2 emit low thermal noise, and therefore, circuit 10 exhibits noise performance levels comparable with bipolar band-gap reference circuits. In addition, BJTs Q1 and Q2 do not contain the trapped charge that often exists in prior art MOS differential pairs. Therefore, $V_{REF}$ in circuit 10 is stable with time and past use history, and does not contain long term drift components that cause the noise problems associated with variations in trapped charge over time that are caused by MOS differential pairs.

In prior art band gap reference circuits that used an amplifier with a p-channel MOS differential pair, an offset voltage may be included in the value of $V_{REF}$ due to variations in the threshold voltages of the differential pair MOS transistors. $V_{REF}$ in these circuits is determined by the base-emitter voltage drop across a BJT and the voltage drop across a resistor. When the temperature of the prior art band reference circuit changes, the voltage of $V_{REF}$ changes from a desired value due to changes in the voltage drops across the resistor and the BJT. The prior art circuits do not reach a balance point when trimming resistors are added to bring $V_{REF}$ back up to the desired value, because the offset voltage introduced by differential pair MOS transistors is included in $V_{REF}$.

$V_{REF}$ in the prior art reference circuit cannot remain substantially constant with changing temperature, because it does not reach a point at which the decrease in the voltage drop across the BJT cancels out the increase in voltage drop across the resistor when $V_{REF}$ is set at the desired value. The offset in $V_{REF}$ introduced by the differential pair MOS transistors may cause a designer to add trimming resistance that cause $V_{REF}$ to reach the desired value, but that is to much or too little trimming resistance to reach the balance point at which the effect of temperature changes are canceled out and no longer effect $V_{REF}$.

Circuit 10 of the present invention is also substantially resistant to small first order variations in supply voltage $V_{CC}$. When $V_{CC}$ increases, the current output of bias current source 11 increases. A small increase in the current through resistors R1 and R2 causes an increase in voltages at the bases of Q1 and Q2. However, the voltage at the base of Q1 increases more than Q2, because the increase in the voltage drop at the base of Q4 is greater than the voltage drop at the base of Q5. Therefore, the current through Q1 decreases below the current through Q2, causing both the gate voltage of M11 and the current through M11 to increase. Diode coupled BJT Q3 is coupled to transistor Ml 11. The channel width-to-length (W/L) ratio of transistors M9 and M10 are designed to be equal. By scaling W/L of M11 to be eight times the W/L of M9 or M10, VDS of M10 substantially matches VDS Of M9, so that the collector current of Q3 is approximately eight times larger than the collector current of Q2 or Q1, minimizing any imbalance of Q1 and Q2 in the feedback loop.

The current through M11 is several times the magnitude of the current through M10 and M9. The current through M11 increases as much as the current through current source 11 increases. Therefore, all of the excess current through current source 11 flows through M11, and the current through transistors M1–M8 and resistors R1 and R2 remains substantially constant.

In a further embodiment of the present invention, the ratio of the current through transistor M11 with respect to the current through transistors M9/M10 may be selected to be any suitable value. For example, MOS transistor M11 may have a W/L that is 20 times the W/L of MOS transistors M9 and M10. In this embodiment, the current through M11 is 20 times the current through M9 and M10.

When $V_{CC}$ decreases, the current output of bias current source 11 decreases. The current through M11 decreases by the same amount that the current through current source 11 decreases. Substantially all of the current drop through current source 11 is subtracted from the current through M11, and the current through transistors M1–M8 and resistors R1 and R2 again remain substantially constant. Therefore, transistor M11 is a feedback circuit that regulates its current so that the current through R1/R2 and Q4–Q9 are substantially constant. This is advantageous, because the feedback circuit causes the voltage drop across resistors R1 and R2 to remain substantially constant (e.g., 162 mV), the base voltages of Q1 and Q2 to remain substantially equal to each other, and the output voltage $V_{REF}$ to remain substantially constant despite small, first order changes in the current through current source 11. Thus, circuit 10 is desensitized from first order variations in $V_{CC}$.

With respect to base currents of Q4 and Q5, the base current of Q4 tends to cancel some but not all of the base current of Q5. Therefore, the base current of Q5 does introduce an error term into the circuit 10 with respect to reaching the balance point at which a zero temperature coefficient is achieved. However, the error term introduced by the base current of Q5 is relatively small and does effect the zero temperature coefficient much. To further ensure that the error term introduced by the base of Q5 is small, the impedances of R1 and R2 should be low relative to the base current of Q5, as is the case in the embodiment of FIG. 1. Also, Q5 can be a vertical PNP BJT, which has a relatively high base-to-collector current gain (β), which further reduces the error term introduced by the base current of Q5.

Parasitic capacitance in the feedback loop of circuit 10 provide sufficient compensation for the loop such that additional frequency compensation need not be added. However, an additional capacitor may be from the base of Q2 to ground to provide additional noise rejection in $V_{REF}$.

Figure 4:
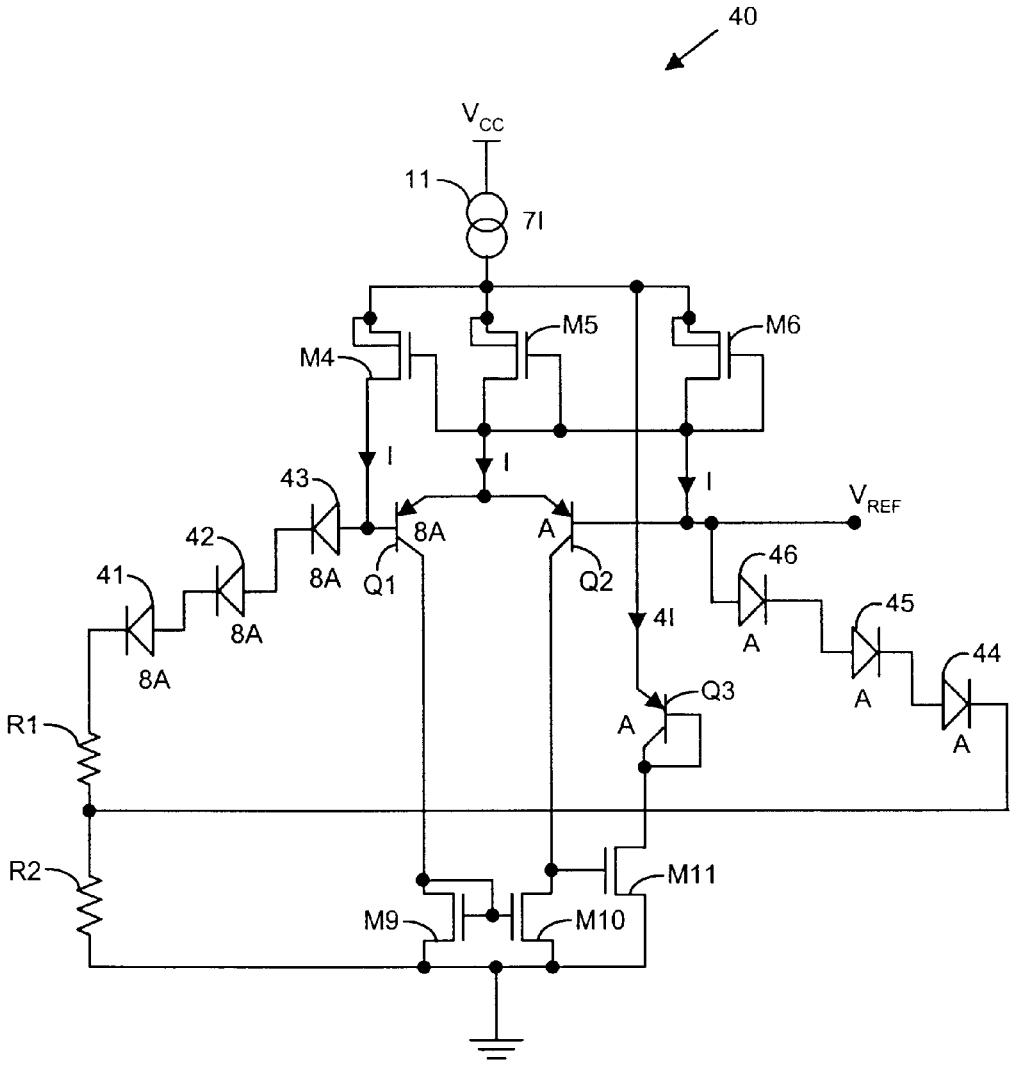
FIG. 4 is a schematic of another embodiment of a band gap reference circuit of the present invention.

Band gap reference circuit 40 shown in FIG. 4 is a further embodiment of the present invention. Circuit 40 includes p-channel MOSFETs M4–M6, n-channel MOSFETs M9–M11, resistors R1 and R2, current source 11, and PNP BJTs Q1 and Q2, as with the embodiment of FIG. 1. Circuit 40 also includes diodes 41–46 in place of BJTs Q4–Q9. Current source 11 outputs a current equal to 7I. Current source 11 provides a current I to each of MOSFETs M4–M6. A current substantially equal to I flows through diodes 41–43 and resistors R1 and R2. A current substantially equal to I also flows through diodes 44–46 and resistor R2. A total current of 2I flows through R2.

In circuit 40, diodes 41–43 have P-N junction areas that are eight times the P-N junction areas of diodes 44–46. Also, Q1 has a base-emitter junction area that is eight times the base emitter junction area of Q2. Therefore, R1 should be selected to have a voltage drop of 54 mV·4=216 mV to compensate for the fact that the voltage drop across Q1 and diodes 41–43 is 216 mV greater than the voltage drop across Q2 and diodes 44–46.

A current of 4I flows through transistor M11. Transistor M11 has a W/L ratio that is eight times the W/L ratio of each of transistors M9 and M10. The feedback circuit comprising M11 and Q3 ensure that a current equal to I/2 flows through each of transistors M9 and M10.

The resistance at R2 may be selected to achieve a desired value at $V_{REF}$. R2 may be trimmed to achieve a zero temperature coefficient at which point output signal $V_{REF}$ remains constant over a range of temperature as discussed above with respect to FIG. 1.

In a further embodiment of the present invention, diodes 43 and 46 in circuit 40 may be eliminated, so that the base of Q1 is coupled directly to diode 42 and the base of Q2 is coupled directly to diode 45. In another further embodiment of the present invention, diodes 42–43 and diodes 45–46 may be eliminated, so that the base of Q1 is coupled directly to diode 41, and the base of Q2 is coupled directly to the diode 44. In still a further embodiment of the present invention, transistor Q4 in circuit 10 may be replaced with diode 41, eliminating transistor M1, and transistor Q5 in circuit 10 may be replaced with diode 44.

In still a further embodiment of the present invention, PNP BJTs Q1–Q2 and BJTs Q4–Q9 may be replaced with NPN bipolar junction transistors. PNP BJT Q3 may also be replaced with a NPN BJT.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth. Therefore, many modifications may be made to adapt a particular situation or material to the teachings of the invention without departing from the essential scope and spirit of the present invention. It is intended that the invention not be limited to the particular embodiments disclosed, but that the invention will include all embodiments and equivalents falling within the scope of the claims.

What is claimed is:

1. A band gap reference circuit coupled to a source of bias current, the baud gap reference circuit comprising:

an amplifier comprising a differential pair of first and second bipolar junction transistors;

a first circuit comprising a first P-N junction coupled to the first bipolar junction transistor;

a second circuit comprising a second P-N junction coupled to the second bipolar junction transistor;

a first resistor coupled to the first circuit;

a second resistor coupled to the first resistor and the second circuit; and a feedback circuit coupled to the amplifier and to the source of bias current, wherein the band gap reference circuit provides an output voltage tat is substantially constant over a range of the bias current.

2. The band gap reference circuit of claim 1 wherein the first and second bipolar junction transistors are PNP transistors.

3. The band gap reference circuit of claim 1 wherein the band gap reference circuit provides an output voltage at the base of the first bipolar junction transistor that is substantially constant over a range of temperatures.

4. The band gap reference circuit of claim 1 wherein:

the first P-N junction in the first circuit forms a portion of a third bipolar junction transistor, and the first circuit further comprises a fourth bipolar junction transistor coupled to the third bipolar junction transistor; and the second P-N junction in the second circuit forms a portion of a fifth bipolar junction transistor, and the second circuit further comprises a sixth bipolar junction transistor coupled to the filth bipolar junction transistor.

5. The band gap reference circuit of claim 4 wherein:

the first circuit further comprises a seventh bipolar junction transistor coupled to the fourth bipolar junction transistor and the first resistor; and the second circuit further comprises an eighth bipolar junction transistor coupled to the seventh transistor and the second resistor;

the third, fourth, and seventh bipolar junction transistors being coupled together as emitter followers; and the fifth, sixth, and eighth transistors being coupled together as emitter followers.

6. The band gap reference circuit of claim 5 wherein the three emitter follower coupled bipolar junction transistors of the first circuit are PNP transistors; and the three emitter follower coupled bipolar junction transistors of the second circuit are PNP transistors.

7. The band gap reference circuit of claim 1 wherein the feedback circuit comprises a third transistor coupled to the amplifier.

8. The band gap reference circuit of claim 7 wherein the feedback circuit comprises a diode coupled sixth fourth bipolar junction transistor coupled to the third transistor.

9. The band gap reference circuit of claim 1 wherein:

the first P-N junction in the first circuit faints a portion of a third NPN bipolar junction transistor, and the first circuit further comprises a fourth NPN bipolar junction transistor coupled to the third NPN bipolar junction transistor, and a fifth NPN bipolar junction transistor coupled to the fourth NPN bipolar junction transistor; and the second P-N junction in the second circuit forms a portion of a sixth NPN bipolar junction transistor, and the second circuit further comprises a seventh NPN bipolar junction transistor coupled to the sixth bipolar junction transistor, and an eight NPN bipolar junction transistor coupled to the seventh NPN bipolar junction transistor.

10. The band gap reference circuit of claim 1 wherein the amplifier, the first and second circuits, the first and second resistors, and the feedback circuit all receive at least some of their bias current from the source of bias current.

11. A band gap reference circuit coupled to a source of bias current, the band gap reference circuit comprising:

an amplifier comprising a differential pair of first and second bipolar junction transistors;

a first circuit comprising third, fourth, and fifth emitter follower coupled bipolar junction transistors;

a second circuit comprising sixth, seventh, and eighth emitter follower coupled bipolar junction transistors;

a first resistor coupled to the first circuit;

a second resistor coupled to the first resistor and the second circuit; and a feedback circuit coupled to the amplifier and to the source of bias current;

wherein each of the third, the fourth, and the fifth emitter follower bipolar junction transistors of the first circuit have base-emitter junction areas that are eight times the base-emitter junction areas of each of the sixth, the seventh, and the eighth emitter follower bipolar junction transistors of the second circuit.

12. A band gap reference circuit coupled to a source of bias current, the band gap reference circuit comprising:

an amplifier comprising a differential pair of first and second bipolar junction transistors;

a first circuit comprising first, second, and third diodes counted in series, the first diode being coupled to the first bipolar junction transistor;

a second circuit comprising fourth, fifth, and sixth diodes coupled in series, the fourth diode being coupled to the second bipolar junction transistor;

a first resistor coupled to the first circuit;

a second resistor coupled to the first resistor and the second circuit; and a feedback circuit coupled to the amplifier and to the source of bias current.

13. A band gap reference circuit coupled to a source of bias current, the band gap reference circuit comprising:

an amplifier comprising a differential pair of first and second bipolar junction transistors;

a first circuit comprising third and fourth emitter follower coupled bipolar junction transistors, wherein the third bipolar junction transistor is coupled to the first bipolar junction transistor; and the fourth bipolar junction transistor is coupled to a first diode;

a second circuit comprising fifth and sixth emitter follower coupled bipolar junction transistors, wherein the fifth bipolar junction transistor is coupled to the second bipolar junction transistor, and the sixth bipolar junction transistor is coupled to a second diode;

a first resistor coupled to the first circuit;

a second resistor coupled to the first resistor and the second circuit; and a feedback circuit coupled to the amplifier and to the source of bias current.

14. A band gap reference circuit coupled to a source of bias current, the band gap reference circuit comprising:

an amplifier comprising a differential pair of first and second bipolar junction transistors;

a first circuit comprising a first P-N junction coupled to the first bipolar junction transistor;

a second circuit comprising a second P-N junction coupled to the second bipolar junction transistor;

a first resistor coupled to the first circuit;

a second resistor coupled to the first resistor and the second circuit; and a feedback circuit coupled to the amplifier and to the source of bias current, wherein the first transistor has a base-emitter junction area that is eight times the base-emitter junction area of the second transistor.

15. A method for providing an output reference voltage from a reference circuit coupled to a bias current source, the method comprising:

providing the output reference voltage using a first P-N junction and a first resistor;

providing a second voltage using a second P-N junction and a second resistor coupled to the first resistor;

comparing the output reference voltage to the second voltage using a differential pair comprising first and second bipolar junction transistors; and regulating a first current through a feedback circuit coupled to the differential pair to compensate for variations in a second current through the first and second resistors so that the second current through the first and second resistors remains substantially constant over a range of bias current from the bias current source.

16. The method of claim 15 wherein the differential pair is coupled to a current minor circuit.

17. The method of claim 15 wherein the first P-N junction farina a portion of a third bipolar junction transistor, and the second P-N junction forms a portion of a fourth bipolar junction transistor.

18. The method of claim 15 wherein the first P-N junction forms a portion of a third bipolar junction transistor, and the output reference voltage is provided using the third, a fourth, and a fifth bipolar junction transistors and the first resistor, and the second P-N junction forms a portion of a sixth bipolar junction transistor, and the second voltage is provided using the sixth, a seventh, and an eighth bipolar junction transistors and the second resistor.

19. The method of claim 18 wherein the third, the fourth, and the fifth bipolar junction transistors are emitter follower coupled; and the sixth, the seventh, and the eighth bipolar junction transistors are emitter follower coupled.

20. The method of claim 19 wherein each of the third, fourth, and fifth bipolar junction transistors have base-emitter junction areas that are eight times the base-emitter junction areas of each of the sixth, seventh, and eight bipolar junction transistors.

21. The method of claim 15 wherein the first P-N function is a first diode, the output reference voltage being provided using the first, a second, and a third diodes coupled in series; and the second P-N junction is a fourth diode, the second voltage being provided using the fourth, a fifth, and a sixth diodes coupled in series.

22. The method of claim 15 wherein the output reference voltage is substantially constant over a range of temperature.

23. A method for providing an output reference voltage, the method comprising:

providing the output reference voltage using first second, and third diodes coupled in series, and a first resistor;

providing a second voltage using fourth, fifth, and sixth diodes coupled in series, and a second resistor that is coupled to the first resistor;

comparing the output reference voltage to the second voltage using a differential pair comprising first and second bipolar junction transistors; and regulating a current through a feedback circuit coupled to the differential pair to compensate for variations in current through the first and second resistors.

24. A method for providing an output reference voltage, the method comprising:

providing the output reference voltage using a first P-N junction and a first resistor;

providing a second voltage using a second P-N junction and a second resistor coupled to the first resistor;

comparing the output reference voltage to the second voltage using a differential pair comprising first and second bipolar junction transistors; and regulating a current through a feedback circuit coupled to the differential pair to compensate for variations in current through the first and second resistors;

wherein the feedback circuit comprises a MOSFET that regulates its drain-source current.

25. The method of claim 24 wherein the MOSFET is coupled to a diode coupled third bipolar junction transistor.

26. A band gap reference circuit coupled to a source of bias current, the band gap reference circuit comprising:

an amplifier comprising a differential pair of first and second bipolar junction transistors;

a first resistor;

a first circuit comprising a first P-N junction, wherein the first circuit is coupled between the first bipolar junction transistor and the first resistor;

a second resistor coupled to the first resistor;

a second circuit comprising a second P-N junction, wherein the second circuit is coupled between the second bipolar junction transistor and the second resistor; and a feedback circuit coupled to the amplifier and to the source of bias current.

27. The band gap reference circuit of claim 26 wherein the first P-N junction forms a portion of a third bipolar junction transistor, and the second P-N junction forms a portion of a fourth bipolar junction transistor.

28. The band gap reference circuit of claim 27 wherein the first circuit further comprises a fifth bipolar junction transistor coupled to the third bipolar junction transistor, and a sixth bipolar junction transistor coupled to the fifth bipolar junction transistor, and the second circuit further comprises a seventh bipolar function transistor coupled to the fourth bipolar junction transistor, and an eighth bipolar junction transistor coupled to the seventh bipolar junction transistor.

* * * * *